US010337247B2

(12) United States Patent
Weston

(10) Patent No.: US 10,337,247 B2
(45) Date of Patent: Jul. 2, 2019

(54) LADDER STABILISER

(71) Applicant: TELETOWER.COM LIMITED, Essex (GB)

(72) Inventor: Richard Weston, Halstead Essex (GB)

(73) Assignee: Teletower.com Limited, Essex (GB)

( * ) Notice: Subject to any disclaimer, the term of this patent is extended or adjusted under 35 U.S.C. 154(b) by 45 days.

(21) Appl. No.: 15/506,767

(22) PCT Filed: Aug. 27, 2015

(86) PCT No.: PCT/IB2015/056500

§ 371 (c)(1),
(2) Date: Feb. 27, 2017

(87) PCT Pub. No.: WO2016/030849

PCT Pub. Date: Mar. 3, 2016

(65) Prior Publication Data

US 2018/0230747 A1 Aug. 16, 2018

(30) Foreign Application Priority Data

Aug. 29, 2014 (GB) ..... 1415376.1
Sep. 16, 2014 (GB) ..... 1416372.9

(51) Int. Cl.
*E06C 7/42* (2006.01)
*E06C 7/46* (2006.01)

(52) U.S. Cl.
CPC ..... *E06C 7/423* (2013.01); *E06C 7/42* (2013.01); *E06C 7/46* (2013.01)

(58) Field of Classification Search
CPC ... E06C 7/42; E06C 7/423; E06C 7/48; E06C 7/484
See application file for complete search history.

(56) References Cited

U.S. PATENT DOCUMENTS 4,011,926 A * 3/1977 Larson ..... E06C 7/42 182/107
4,744,471 A * 5/1988 Leister ..... E04H 4/10 160/330
5,121,814 A * 6/1992 Southern ..... E06C 7/48 182/111

(Continued)

FOREIGN PATENT DOCUMENTS

DE 20305567 U1 10/2003
DE 202014100469-U1E06 C * 2/2014 ..... E06C 7/46

(Continued)

*Primary Examiner* — Colleen M Chavchavadze
(74) *Attorney, Agent, or Firm* — Adenike Adebiyi

(57) ABSTRACT

A stabilizer accessory releasably securable to a ladder having two one piece stiles and at least three rungs extending between the stiles, characterized by an elongate housing to be secured in use to the lower end of the stiles of the ladder and two stabilizing arms retractably received within the housing and extendable laterally in opposite directions, when deployed, to contact the ground at points that are further spaced apart than the ends of the housing, wherein the stabilizing arms are spring biased in a direction to protrude from the housing and are retained within the housing, and a catch mechanism is provided on the housing to retain the stabilizer arms in the retracted position.

8 Claims, 9 Drawing Sheets

(56) References Cited

U.S. PATENT DOCUMENTS

| | | | | | |
|---|---|---|---|---|---|
| 5,857,544 | A * | 1/1999 | Del Sole | E06C 7/42 | 182/180.2 |
| 6,053,284 | A * | 4/2000 | Fountain | E06C 7/42 | 182/180.2 |
| 6,959,785 | B1 * | 11/2005 | Chilton | E04G 5/02 | 182/107 |
| 8,251,180 | B1 * | 8/2012 | Paige | E06C 7/48 | 182/107 |
| 8,365,865 | B2 * | 2/2013 | Moss | E06C 1/12 | 182/109 |
| 9,347,263 | B2 * | 5/2016 | Weston | E06C 1/125 | |
| 9,416,591 | B2 * | 8/2016 | Kieffer | E06C 1/125 | |
| 9,803,422 | B2 * | 10/2017 | Johnson | E06C 1/397 | |
| 2015/0191975 | A1 * | 7/2015 | Cox | E06C 1/397 | |

FOREIGN PATENT DOCUMENTS

| | | | |
|---|---|---|---|
| GB | 2503742 | A | 1/2014 |
| JP | 2012012893 | A | 1/2012 |

* cited by examiner

LADDER STABILISER

FIELD

This invention relates to ladders and more specifically to increasing the stability of both fixed and telescopic ladders when in use.

BACKGROUND

The nature of ladders provides great chance of injury as a result of the heights they enable their users to reach. Ongoing changes in legislation seek to make the use of ladders ever safer. With this goal in mind, proposals exist to make the use of stabilisers mandatory. Such stabilisers widen the footprint of the ladder to increase their resistance to tipping sideways. The suggested width of the stabilisers being a function of the maximum height of the ladder.

Previous stabilisers are in the form of a laterally extending bar secured to the base or foot of the ladder. The ends of the bar having feet for engagaing the ground either instead of or in addition to the feet of the ladder at the bottom of the stiles. While these serve the purpose of providing stability, they are bulky and cumbersome when transporting the ladder. The solution to this is to make the stabiliser readily removable resulting on additional time required to set up the ladder and also the option of some users choosing not to utilise a stabiliser which can result in legal action against an employer in the event of an accident.

SUMMARY

In the present disclosure, there is provided an accessory for a ladder that is releasably securable to a ladder having two one piece stiles and at least three rings extending between the stiles. In some embodiments of the present disclosure, the stabiliser accessory includes an elongate housing to be secured in use to a lower end of the stiles of the ladder and two stabilising arms retractably received within the housing and extendable laterally in opposite directions, when deployed, to contact the ground at points that are further spaced apart than the ends of the housing. The stabilising arms are spring biased in a direction to protrude from the housing and are retained within the housing. A catch mechanism is provided on the housing to retain the stabiliser arms in the retracted position.

Preferably, the stabilisers may be released by the application of a downward force to the top of the housing.

Additionally, the force may be applied to an actuator situated on the upper side of the accessory.

Alternatively, the stabilisers may be released automatically by the action of resting the ladder on the ground.

Alternatively, at least one stabiliser may be released by contact between a foot positioned at the end of the at least one stabiliser and the ground.

Preferably, at least one stabilising arm may have a pivotably attached foot that includes a hook for engaging with the housing to retain the arm within the housing, such that contact with ground rotates the foot causing the hook to disengage from the housing and the arm to deploy.

Alternatively, the catch mechanism may be released by application of a force to displace the stabilising arms vertically relative to the housing.

Preferably, both arms may be released by actuation of the catch mechanism of one of the arms.

The arms may extend coaxially from the housing in opposing directions.

The arms may be arranged adjacent one another when retained within the housing.

Preferably, a spring biasing each arm may be received inside the arm and is guided by a telescopically sectioned spring guide.

Additionally, each arm may be formed of at least two telescoping sections.

BRIEF DESCRIPTION OF DRAWINGS

The invention will now be described further by way of example with reference to the accompanying drawings, in which.

DETAILED DESCRIPTION

Figure 1:
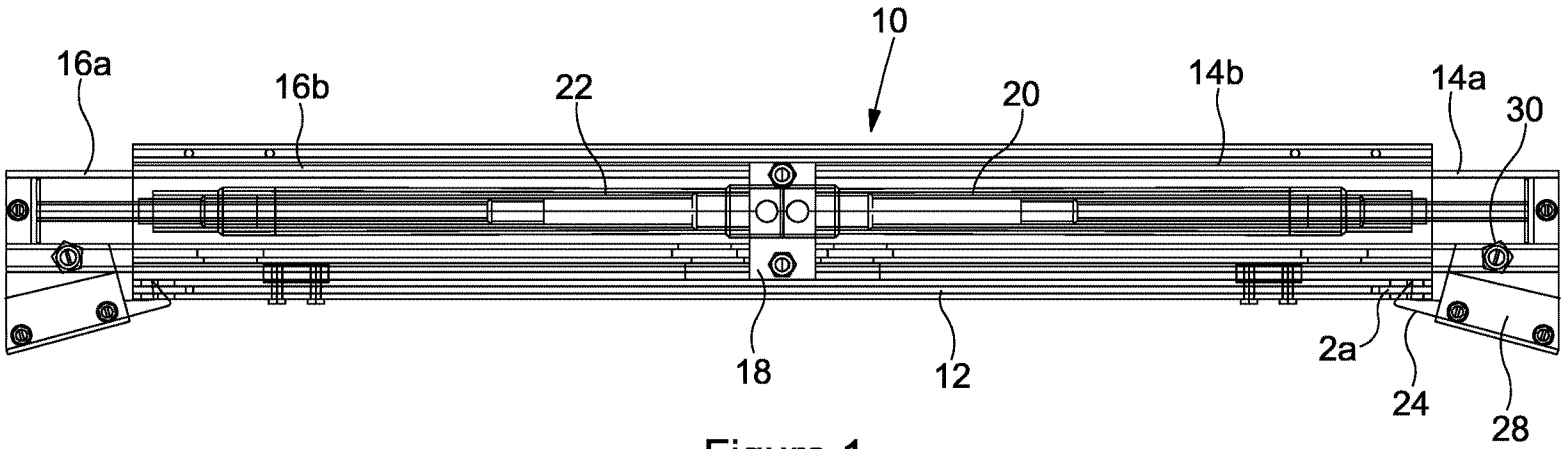
FIG. 1 shows an X-ray view of a first embodiment of the present invention in the collapsed position.

The present invention relates to an accessory for attaching to either a fixed or telescopic construction ladder 8. Although different embodiments utilise unique features for different purposes, common features will be labelled using the same numbering. Turning to FIG. 1, accessory 10 is shown as an X-ray image so that internal components can be seen. The outer section of the accessory is a housing 12 which is made from extruded aluminium and is typically rectangular in section.

The housing 12 is hollow for receiving stabiliser arms 14 and 16, which are free to slide within the housing along guides (not shown). In this embodiment, the two arms are each made up of two telescoping box sections 14*a*, 14*b* and 16*a*, 16*b*. The "a" sections, slide inside the "b" sections. In this embodiment, the arms 14 and 16 slide along a coaxial path and extend from opposite open ends of the housing 12. At their inner most end, the arms 14 and 16 abut buttress 18 which serves as a motion stop. Buttress 18 also acts as the inner anchor point for springs 36 (not shown until FIG. 3) which serve to push between the outward face of the buttress 18 and the arm sections 14*a* and 16*a* urging them both outwards (in opposing directions). The springs are contained within telescopic spring guides 20 and 22 that serve to aid in the extension and contraction of the spring by preventing bending and binding within the hollow housing 12.

While the description of this embodiment shows the arms extending coaxially, for increased stabiliser arm length it is possible for the housing 12 to contain adjacent box sections, each receiving a collapsed telescopic or rigid non-telescopic stabiliser arm substantially the entire length of the housing 12, such as is described in GB1415376.1, incorporated herein by reference.

Figure 2:
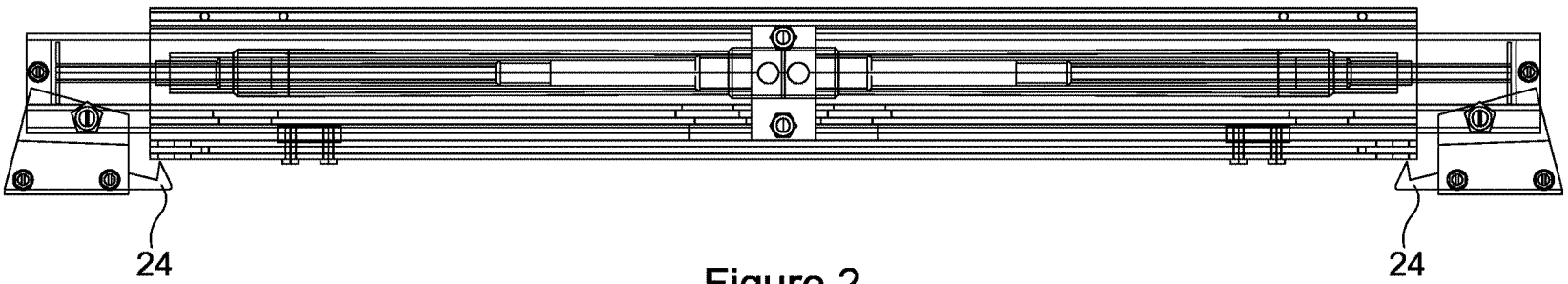
FIG. 2 shows the same embodiment as FIG. 1, after release of its latch mechanisms, but prior to extension of its arms.

Despite the resilience of the springs urging the arms 14 and 16 outwards, the arms are prevented from extending by a catch mechanism. In a first embodiment shown in FIGS. 1 to 3, the mechanism is in the form of a hook 24 engaged within a hole 26 in the outer surface of the housing 12. The hook 24 extends from a foot 28 that is pivotably attached at pivot 30 to each arm (14,16) at its outer most end. The pivot 30 is offset toward one end of the foot 28 such that when the feet come into contact with the ground, the outer edges of the feet contact the ground first. The reaction force on the feet caused by the weight of the ladder and the accessory, pushes upwards on the feet causing them to rotate about their pivots. This rotation serves to pull the hooks 24 out of engagement with the holes 26 as shown in FIG. 2.

Figure 3:
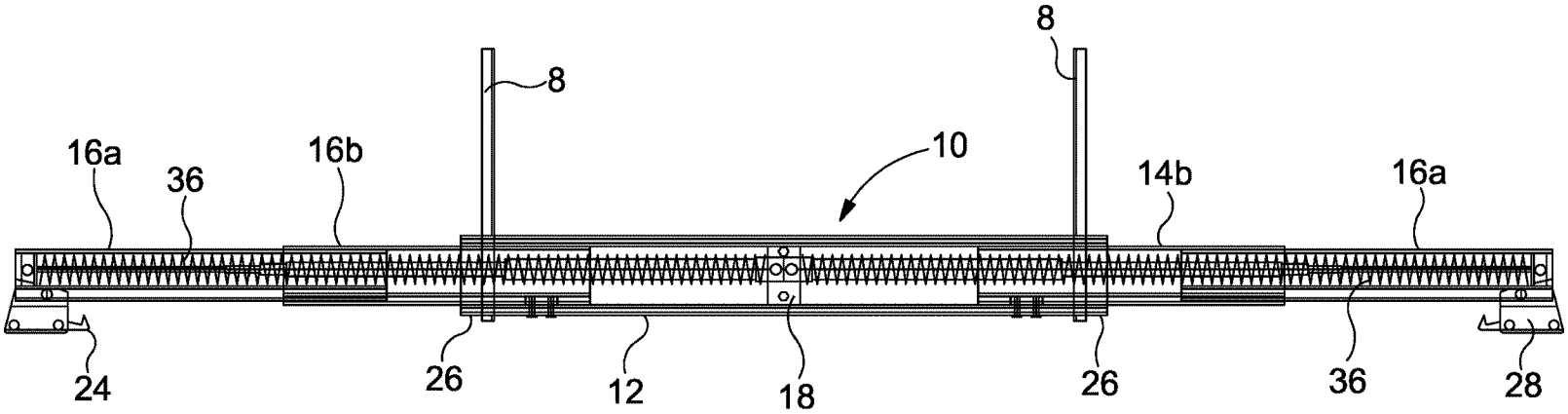
FIG. 3 shows the same embodiment as FIGS. 1 and 2 after extension of its arms.

Once the hooks 24 are released, the resilience of the springs urges the stabiliser arms 14, 16 outwards into the deployed position shown in FIG. 3.

To collapse the stabilisers into the retained position, force must be applied manually to the outer face of the arms 14, 16 to push them back into the housing 12. When the hooks 24 come into contact with the outward facing edge of the housing 12 a cam surface on their leading edge urges the hooks 24 downwards, by rotating the feet 28 downwards to then allow the hooks 24 to engage within the holes 26.

Figure 4:
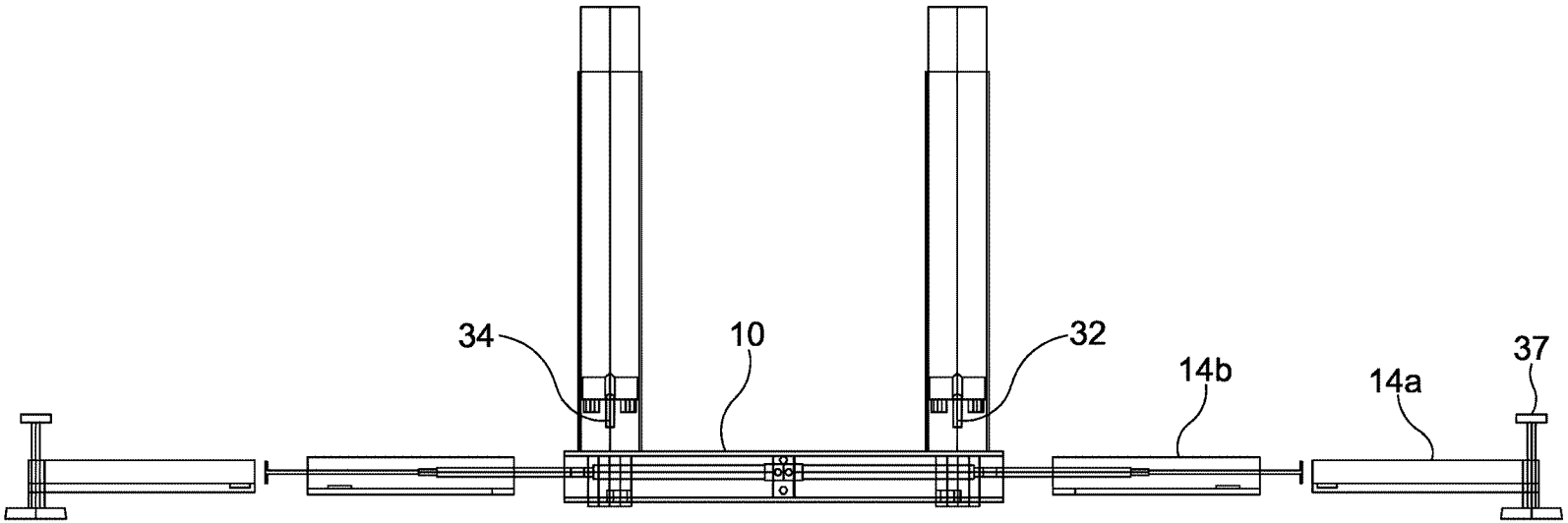
FIG. 4 shows an exploded view of a prior art embodiment utilising automatic release of stabiliser arms upon actuation of a telescopic ladder.
Figure 5:
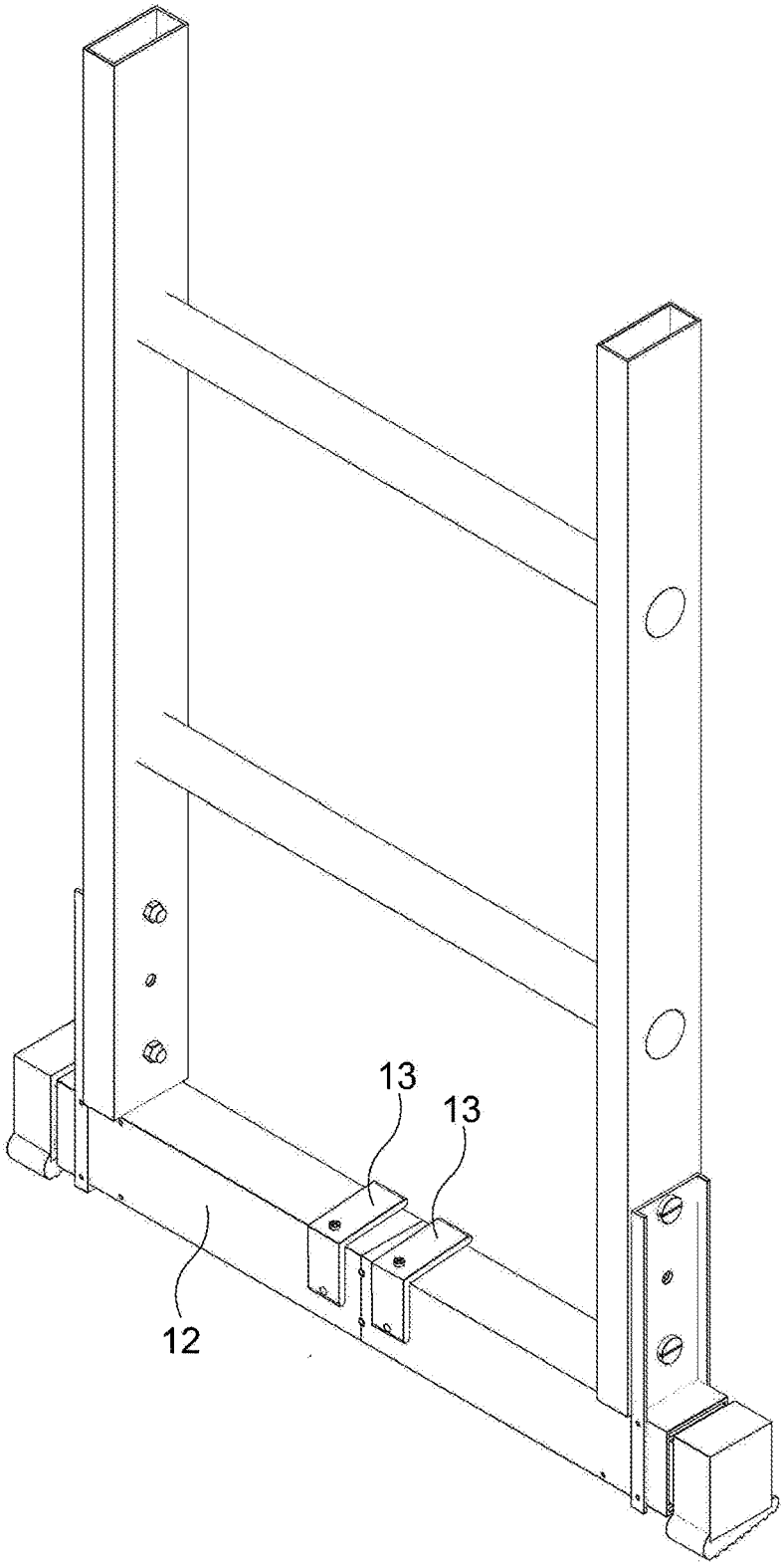
FIG. 5 shows a perspective view of a ladder attached to a stabiliser according to a second embodiment of the present invention, with its stabiliser arms in the retracted position
Figure 6:
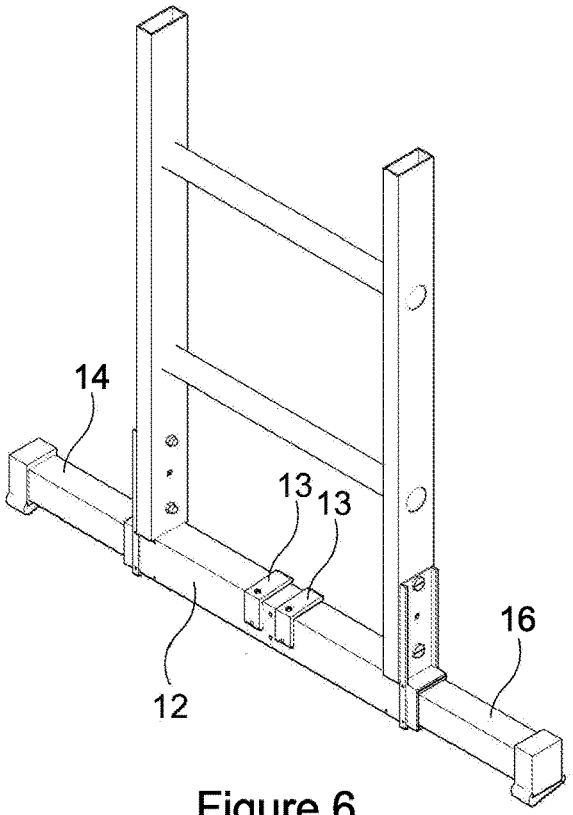
FIG. 6 shows the embodiment of FIG. 5, with its stabilising arms in the extended position.
Figure 7:
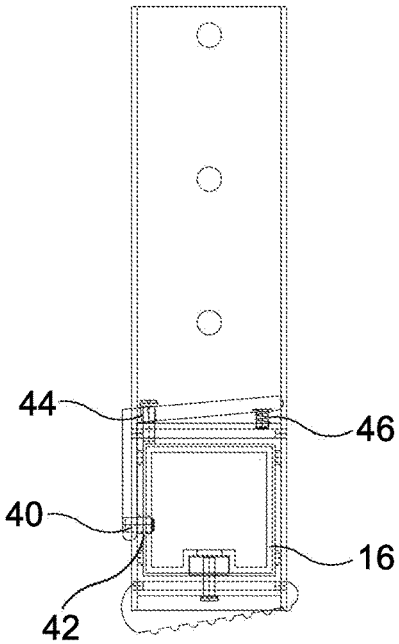
FIG. 7 shows a section through the embodiment of FIG. 5.
Figure 8:
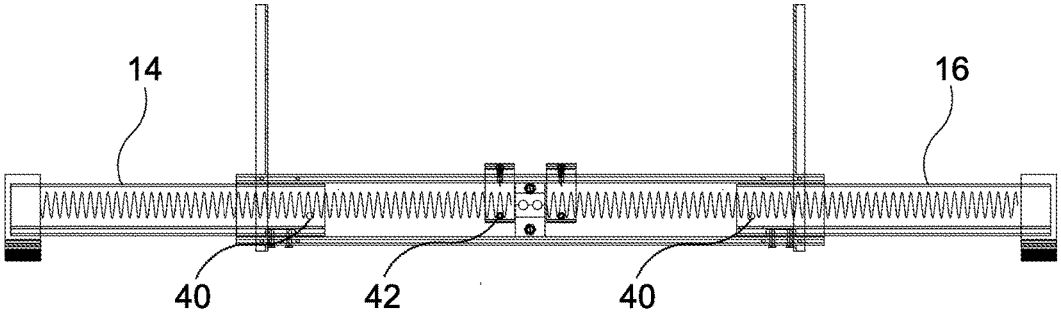
FIG. 8 shows an X-ray view of the stabiliser of FIG. 5 with its arms extended.
Figure 9:
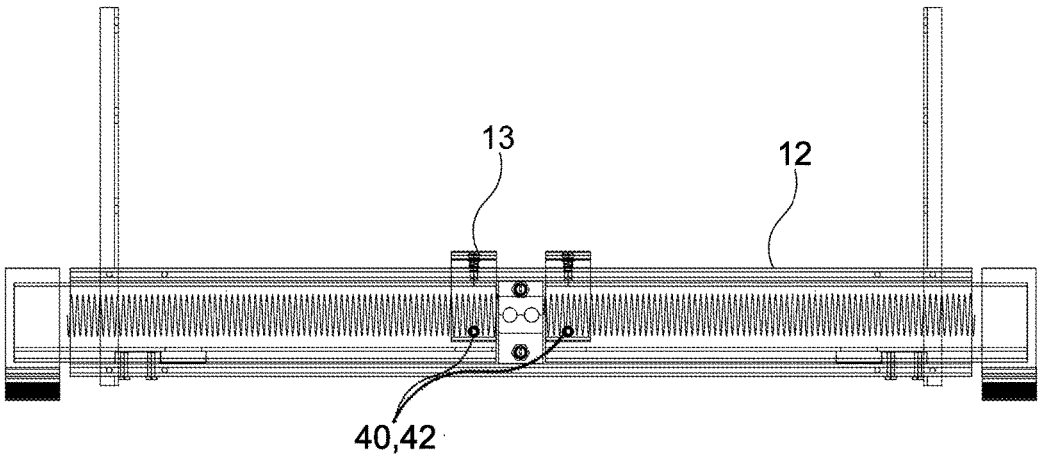
FIG. 9 shows an X-ray view of the stabiliser of FIG. 5 with its arms retracted.

FIG. 4 shows a prior art example of a telescopic ladder equipped with stabilisers which extend automatically upon separation of the telescopic stiles. It shows the inside of the stiles of the ladder having engagement pins 32 and 34 which retract upon opening of the telescopic ladder to allow stabilisers to extend. This feature is already the subject of granted patent GB2503742 (incorporated herein by reference) and is not relevant to the current workings of this invention. The drawing is included here as it shows an alternative type of foot intended for use with an embodiment of the present invention.

FIGS. 1 to 3 show pivoted foot 28, wherein release of the stabiliser arm(s) 14, 16 is achieved by placement of the ladder on the ground. In the prior art embodiment shown in FIG. 4, the height of the feet is adjustable by means of a threaded shaft or foot adjuster 37. The adjustment mechanism enables the operator of the ladder to ensure that the stabiliser arms are in firm contact with the ground when in use. When utilising this design of foot, an alternative mechanism for release of the stabilisers is required since the catch mechanism is not disposed between the feet and the housing, examples of alternative release mechanisms are shown in three further embodiments in FIGS. 5 to 11. The advantage of these embodiments is that they allow the user to determine when the stabilisers will be deployed, rather than release occurring automatically as the ladder is placed on the ground as in the first embodiment.

The second, third and fourth embodiments of the present invention utilise a catch mechanism arranged between the stabiliser arms 14, 16 themselves and the housing. In these embodiments, the mechanism takes the form of a pin 40 engaged within a hole 42. The pin and hole are arranged between each of the arms and the housing to prevent relative movement until actuation of the mechanism affects removal of the pin from the hole. Actuation may be by displacement of the pin relative to the arms as is the case in the second embodiment shown in FIGS. 5 to 9, or by vertical movement of the arm relative to the housing as shown in the third and fourth embodiments in FIGS. 10 and 11 respectively.

In a second embodiment, shown in FIGS. 5 to 9, the housing 12 is constructed with an external actuator step 13 associated with each arm, 14,16. The actuator step is free to rock about pivot 44 but is urged into a rest position by spring 46. When in the rest position shown in the cross sectional diagram of FIG. 7, pin 40 extends through a hole in the housing 12, into a further hole 42 disposed within arm 16. When desired, a user of the ladder steps onto actuator step 13 causing it to rock about pivot 44 against the actuation of spring 46. The rocking movement serves to retract pin 40 from hole 42, allowing the arm to be urged outwards by the action of spring 36.

In the embodiment shown, an actuator as described above is independently associated with each arm 14,16 to enable the arms to be released individually. It is equally possible for a common actuator step 13 to be associated via two pins 40 with both stabiliser arms although this is considered less preferable due to the difficulty in restoring the arms into the locked retracted position.

Figure 10:
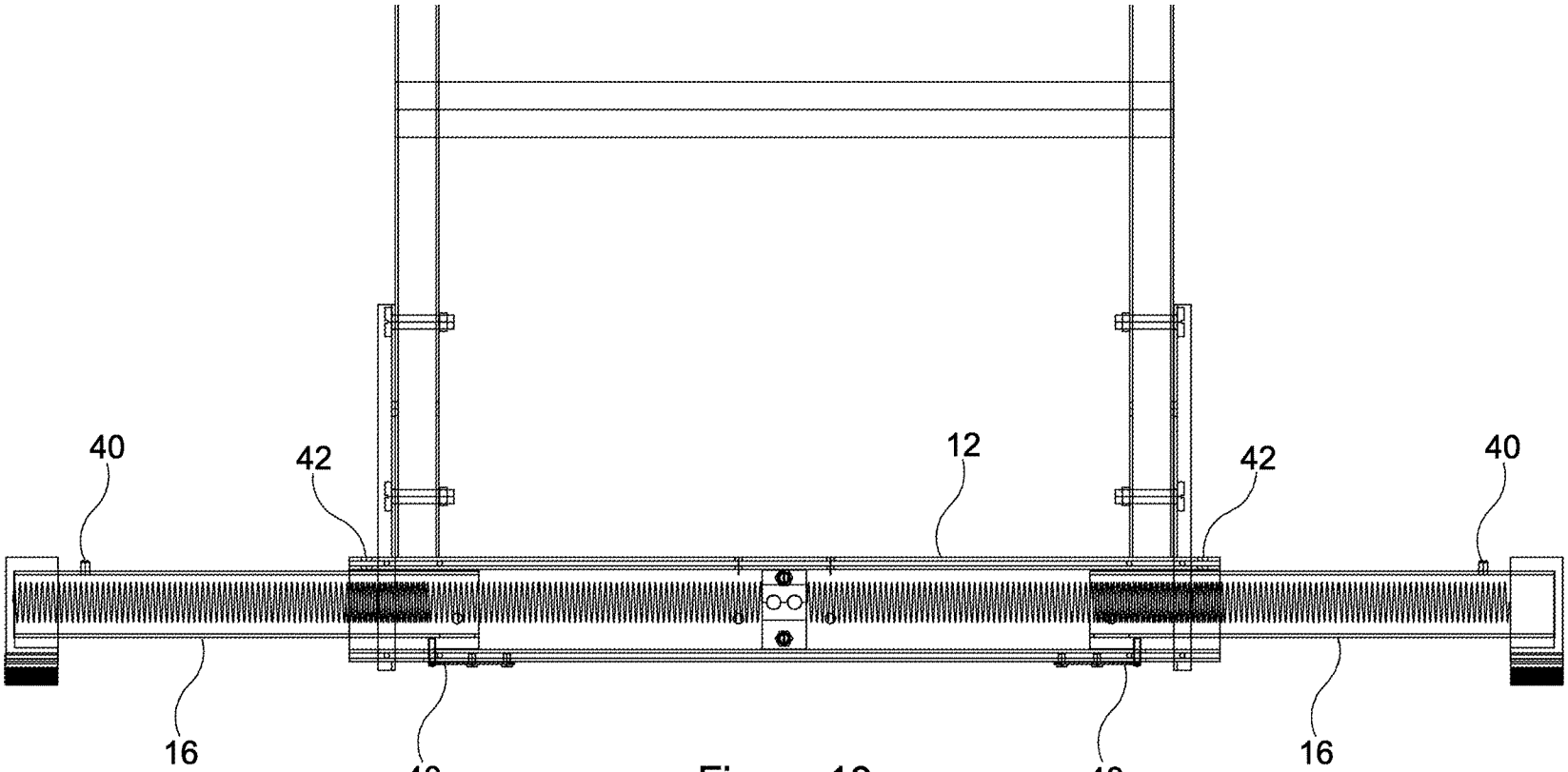
FIG. 10 shows an X-ray view of a third embodiment having a different actuation mechanism from the first and second embodiments.
Figure 11:
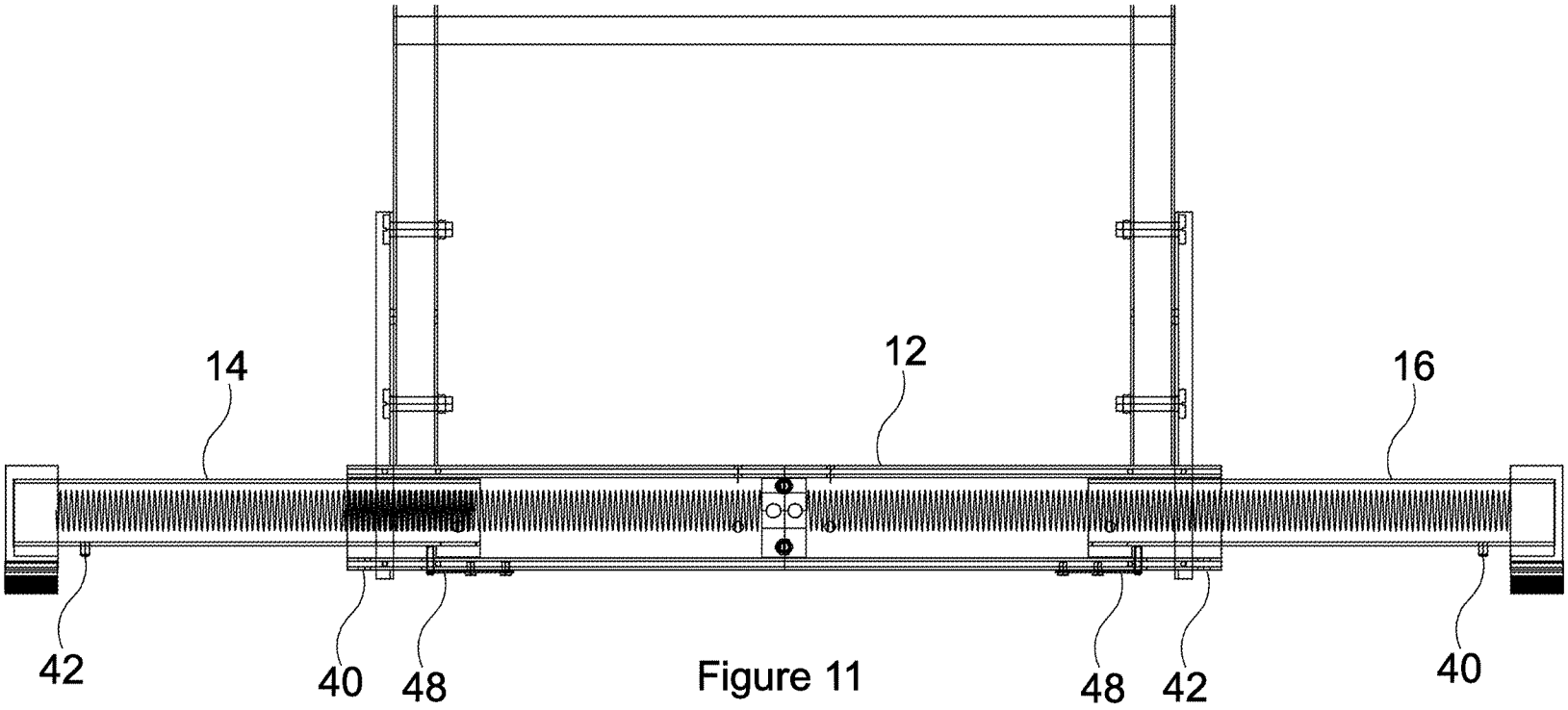
FIG. 11 shows an X-ray view of a fourth embodiment having a different actuation mechanism from the first second and third embodiments.

In the third and fourth embodiments, of FIGS. 10 and 11 respectively, by virtue of the design of the stabiliser accessory there is a degree of movement designed in to the construction. This enables the arm to be displaced vertically, providing enough movement to disengage pin 40 from hole 42 provided in the housing 12. This allows the arms to be urged outwards by the force in the spring 36. Such an arrangement may be actuated by deflection of the arms downwards as in the third embodiment shown in FIG. 10, or upwards as in the fourth embodiment shown in FIG. 11. Depending on preference and ease of manufacture/assembly the pin 40 may be disposed on the arm 14,16 or the housing, all that is required is that it may engage with a corresponding hole 42 in the housing 12.

As the mechanism is operated by vertical displacement of the arms when in the collapsed or retained position, it is intended that a user may simply release the mechanism by tapping on the top or underside of the foot adjuster 37 or stabiliser arm 14,16 in order to displace it vertically in the appropriate direction to cause the stabiliser arm to deploy. To prevent the arms 14,16 from flapping around as a result of the free movement required to displace the pins 40 relative to holes 42, the third and fourth embodiments of FIGS. 10 and 11 and further supplied with spring levers 48.

In a preferred embodiment, the stabiliser arms are formed of two parts, 14*a* sliding within 14*b* which itself slides within one end of the housing 12 (FIGS. 1 to 4). It is also possible to form the stabiliser arms 14 and 16 as single pieces (FIGS. 5 to 11) which each telescopically extend from opposing sides of the housing 10.

Depending on the whether or not the stabilising arms are themselves two piece telescopic arms, it may be necessary for the locking pins 40 to extend through holes 42 in both sections a and b of each arm in order for the arm to be fully retained. This will depend on the location of the pin 40 within the housing and relative to the arm sections when in the collapsed position inside the housing 12.

The invention claimed is:

1. A stabiliser accessory releasably securable to a ladder having two one piece stiles and at least three rungs extending between the stiles, the stabiliser accessory comprising:

an elongate tubular housing to be secured in use to a lower end of the stiles of the ladder, two stabilising arms each having an end with a foot attached thereto, the stabilising arms retractably received within the housing and slidable laterally in opposite directions relative to the housing between a retracted position, in which the stabilising arms reside within the housing, and a deployed position, in which the feet attached to the ends of the stabilising arms contact the ground at points that are further spaced apart than the ends of the housing, wherein the stabilising arms are spring biased in a direction to protrude from the housing and are retained within the housing, and a catch mechanism is provided on the housing to retain the stabiliser arms in the retracted position, the spring biasing of the stabilising arms serving to move the arms to the deployed position upon release of the catch mechanism, and wherein the stabilising arms are released by the application of a downward force to the top of the housing.

2. A stabiliser accessory as claimed in claim 1, wherein the force is applied to an actuator situated on an upper side of the accessory.

3. A stabiliser accessory as claimed in claim 1, wherein both arms are released by actuation of the catch mechanism of one of the arms.

4. A stabiliser accessory as claimed in claim 1, wherein the arms extend coaxially from the housing in opposing directions.

5. A stabiliser accessory as claimed in claim 1, wherein the arms are arranged adjacent one another when retained within the housing.

6. A stabiliser accessory as claimed in claim 1, wherein each arm is formed of at least two telescoping sections.

7. A stabiliser accessory releasably securable to a ladder having two one piece stiles and at least three rungs extending between the stiles, the stabiliser accessory comprising:

an elongate tubular housing to be secured in use to a lower end of the stiles of the ladder;

two stabilising arms each having an end with a foot attached thereto, the stabilising arms retractably received within the housing and slidable laterally in opposite directions relative to the housing between a retracted position, in which the stabilising arms reside within the housing, and a deployed position, in which the feet attached to the ends of the stabilising arms contact the ground at points that are further spaced apart than the ends of the housing;

wherein the stabilising arms are spring biased in a direction to protrude from the housing and are retained within the housing, and a pair of catch mechanisms are provided on the housing to retain the stabiliser arms in the retracted position, one of the pair of catch mechanisms provided for each stabiliser arm, the spring biasing of the stabilising arms serving to move the arms to the deployed position upon release of the catch mechanism; and wherein each respective catch mechanism is released by application of a force to displace the respective stabilising arm vertically relative to the housing.

8. A stabiliser accessory releasably securable to a ladder having two one piece stiles and at least three rungs extending between the stiles, the stabiliser accessory comprising:

an elongate tubular housing to be secured in use to a lower end of the stiles of the ladder;

two stabilising arms each having an end with a foot attached thereto, the stabilising arms retractably received within the housing and slidable laterally in opposite directions relative to the housing between a retracted position, in which the stabilising arms reside within the housing, and a deployed position, in which the feet attached to the ends of the stabilising arms contact the ground at points that are further spaced apart than the ends of the housing;

wherein the stabilising arms are spring biased in a direction to protrude from the housing and are retained within the housing, and a catch mechanism is provided on the housing to retain the stabiliser arms in the retracted position, the spring biasing of the stabilising arms serving to move the arms to the deployed position upon release of the catch mechanism; and wherein a spring biasing each arm is received inside the arm and is guided by a telescopically sectioned spring guide.

* * * * *